US009260928B2

(12) United States Patent
Strange

(10) Patent No.: US 9,260,928 B2
(45) Date of Patent: Feb. 16, 2016

(54) DRILL RIG AND ASSOCIATED DRILL RIG TRAVERSE SYSTEM

(71) Applicant: STRADA DESIGN LIMITED, St. Helier, Jersey (GB)

(72) Inventor: Warren Strange, Bicton (AU)

(73) Assignee: Strada Design Limited, St. Helier, Jersey (GB)

( * ) Notice: Subject to any disclaimer, the term of this patent is extended or adjusted under 35 U.S.C. 154(b) by 0 days.

(21) Appl. No.: 14/677,095

(22) Filed: Apr. 2, 2015

(65) Prior Publication Data

US 2015/0285011 A1 Oct. 8, 2015

Related U.S. Application Data

(63) Continuation of application No. 13/190,140, filed on Jul. 25, 2011, now Pat. No. 8,997,892.

(30) Foreign Application Priority Data

Feb. 7, 2011 (AU) ..... 2011900387

(51) Int. Cl.

| | |
|---|---|
| ***E21B 7/00*** | (2006.01) |
| ***E21B 23/00*** | (2006.01) |
| ***E21B 19/083*** | (2006.01) |
| ***E21B 3/02*** | (2006.01) |
| ***E21B 15/00*** | (2006.01) |

(52) U.S. Cl.

CPC ..... *E21B 19/083* (2013.01); *E21B 3/02* (2013.01); *E21B 15/00* (2013.01)

(58) Field of Classification Search

CPC ..... E21B 19/02; E21B 19/006; E21B 19/084; E21B 19/086; E21B 3/02; E21B 15/00

USPC ..... 166/77.51; 175/57, 195, 202, 203; 254/385, 386

See application file for complete search history.

(56) References Cited

U.S. PATENT DOCUMENTS

| | | | |
|---|---|---|---|
| 3,659,655 | A | 5/1972 | Gyongyosi |
| 3,793,835 | A | 2/1974 | Larralde |

(Continued)

FOREIGN PATENT DOCUMENTS

| | | | |
|---|---|---|---|
| FR | 2497869 | A | 7/1982 |
| JP | 2000-160977 | A | 6/2000 |

OTHER PUBLICATIONS

International Search Report Australian Application No. 2011900387 dated Apr. 13, 2011.

*Primary Examiner* — Kenneth L Thompson
*Assistant Examiner* — Michael Wills, III
(74) *Attorney, Agent, or Firm* — Foley & Lardner LLP

(57) ABSTRACT

A drill rig 10 has a drill tower 12, rotation head 14 and drill table 16. The rotation head 14 is supported on and linearly traversable along drill tower 12. A drill rig traverse system 20 provides pull back and pull down force to the rotation head 14 enabling the rotation head 14 to traverse along drill tower 12 and controlling contact force between a drill bit and toe of a hole being drilled. The system 20 is formed as a combination of a hydraulic ram traverse system 22 providing both pull back and pull down force; and a winch pull back system 24 providing pull back only. Both hydraulic ram traverse system 22 and winch pull back system 24 can traverse the rotation head for the full length of the tower 12 when simultaneously applying pull back to the rotation head 14.

20 Claims, 2 Drawing Sheets

(56) References Cited

U.S. PATENT DOCUMENTS

| | | | |
|---|---|---|---|
| 3,835,940 | A | 9/1974 | Winter, Jr. |
| 3,960,360 | A | 6/1976 | Elliston |
| RE29,564 | E | 3/1978 | Larralde et al. |
| 4,170,340 | A | 10/1979 | Mouton, Jr. |
| 4,251,176 | A | 2/1981 | Sizer et al. |
| 4,371,041 | A | 2/1983 | Becker et al. |
| 4,858,694 | A | 8/1989 | Johnson et al. |
| 6,672,410 | B2 | 1/2004 | Smith |
| 8,622,151 | B2 | 1/2014 | Ledbetter |
| 2009/0139731 | A1 | 6/2009 | Rieder et al. |
| 2009/0314547 | A1 | 12/2009 | Stoetzer et al. |

DRILL RIG AND ASSOCIATED DRILL RIG TRAVERSE SYSTEM

CROSS-REFERENCE TO RELATED APPLICATIONS

This application is a Continuation of U.S. application Ser. No. 13/190,140, filed Jul. 25, 2011, which claims priority from Australian Application No. 2011900387, filed Feb. 7, 2011.

FIELD OF THE INVENTION

The present invention relates to a drill rig and an associated drill rig traverse system which provides pull back and pull down force for the drill rig.

The present invention also relates to a drill rig traverse system for a drill rig.

BACKGROUND OF THE INVENTION

A typical drill rig comprises a tower which supports a drill head that in turn rotates a drill string. The drill head linearly traverses up and down the tower to enable the drilling of a hole. The traversing of the drill head and drill string is effected by one or more hydraulic rams. When initially drilling the hole, the hydraulic rams are operated to provide a pull down force to the drill string in order to enable it to penetrate into the ground. As hole depth increases, the length and thus the weight of the drill string increases. Eventually the weight of the drill string will reach a point where it is necessary to apply pull back to the drill head to reduce the contact force or pressure of the drill bit on a toe of the hole. This extends drill bit life thereby reducing down time involved in tripping the string to change the bit. The maximum pull back force provided by the hydraulic rams determines the maximum depth hole that can be drilled by a particular drill rig.

SUMMARY OF THE INVENTION

In broad terms, the present invention is a drill rig traverse system that comprises in combination one or more rams to provide pull back and pull down force, and a winch that can be selectively engaged with a drill head of a drill rig to provide additional pull back force. The pull back force provided by the winch may be multiplied by the use of a compound pulley system. Both the hydraulic rams and the winch may be operated from a common hydraulic fluid source. It is envisaged that the winch will be engaged with the rotation head at least once the depth of the hole has reached a point where pull back force is required to be applied to the drill string. More particularly, the winch may be engaged once a maximum pull back force that can be provided by the hydraulic rams has been reached.

One aspect of the invention provides a drill rig traverse system for a drill rig having a drill tower and a rotation head linearly traversable on the drill tower, the drill rig traverse system comprising:

ram traverse system having at least one ram capable of providing both pull down and pull back force to the rotation head and arranged to traverse the rotation head for substantially a full length of an associated drill tower; and, a winch pull back system selectively engagable with the rotation head to provide additional pull back force to the rotation head, the winch pull back system having a winch that in use is mounted on the tower.

In one embodiment the winch pull back system applies pull back force to the rotation head through a pulley arrangement which is arranged to provide a mechanical advantage of two or more.

The pulley arrangement may comprise a compound pulley having a moveable axle on which a plurality of pulley wheels is rotatably supported.

The movable axle may be selectively engagable with the drill head.

The pulley arrangement may comprise a fixed axle which is fixed to the drill tower and wherein a plurality of pulley wheels is rotatably supported on the fixed axle.

In one embodiment the winch is mounted on the drill tower below a drill table of the drill rig.

The at least one ram may be attached to a top end of the drill tower.

The drill rig traverse system may comprise a releasable locking mechanism capable of releasably locking the movable axle to the rotation head.

In one embodiment winch pull back system and the ram traverse system are arranged to apply equal pull back force when the winch is engaged with the rotation head. In this embodiment the drill rig traverse system comprises a hydraulic fluid supply system and wherein the winch pull back system is hydraulically operated, the hydraulic fluid supply system being arranged to provide hydraulic fluid to both the winch pull back system and the ram traverse system.

In another embodiment the winch pull back system and the ram traverse system may be arranged to apply equal pull back force when the winch is engaged with the rotation head up to a first force being the a lowest of the maximum pull back capacity of the winch pull back system and the ram traverse system. In this embodiment the drill rig traverse system comprises a hydraulic fluid supply system and wherein the winch pull back system is hydraulically operated, the hydraulic fluid supply system being arranged to provide equal hydraulic fluid pressure to both the winch pull back system and the ram traverse system up to a first pressure being the pressure at which the first force is reached.

The drill rig traverse system may comprise a hydraulic fluid supply system which provides hydraulic fluid to both the winch pull back system and the ram traverse system.

The hydraulic fluid supply system may provide equal hydraulic fluid pressure to both the winch pull back system and the ram traverse system up to a first pressure being the pressure at which the first force is reached.

The hydraulic fluid supply system may be arranged to provide higher fluid pressure than the first pressure to the winch pull back system or the ram traverse system, which ever has the higher force rating, wherein the maximum pull back provided by the drill rig is the sum of the maximum force rating of the winch and the maximum force rating of the ram traverse system.

In an alternate embodiment the winch pull back system is electrically operated.

The ram traverse system may comprise one or more rams and a ram pulley system arranged to cause the rotation head to traverse along the tower by a distance twice an extension or retraction displacement of the one or more rams.

In a second aspect the invention provides a method of drilling a hole comprising:

providing a drill rig having a drill tower, a rotation head linearly traversable along the drill tower arranged and a ram traverse system having at least one ram coupled to rotation head and the drill tower to provide pull back and pull down force, the ram traverse system arranged to traverse the rotation head for substantially a full length of the tower;

operating the drill rig to drill a hole to a depth where pull back force is required to be provided by the ram traverse system during drilling of the hole; and, mounting a winch of a winch pull back system on the drill tower;

engaging the winch pull back system with the rotation head to provide additional pull up force while simultaneously operating the ram traverse system to provide pull back force to the rotation head drill rig to drill the hole.

Operating the drill rig to drill a hole may comprise operating the drill rig to drill the hole to a first depth limited by a maximum pull back force provided by the ram traverse system, and engaging the winch pull back system with the rotation head and operating the drill rig to continue drilling the hole to a second deeper depth limited by a combined pull back force of the ram traverse system and the winch pull back system.

The method may comprise operating the winch pull back system and the ram traverse system from a common hydraulic fluid supply.

In one embodiment the method may comprise operating the winch pull back system and the ram traverse system to apply equal pull back on the rotation head up to a maximum pull back being twice the pull back of the maximum pull back provided by either one of the winch pull back system and the ram traverse system when the maximum pull back provided by the winch pull back system and the ram traverse system are the same.

In an alternate embodiment the method may comprise operating the winch pull back system and the ram traverse system to apply equal pull back on the rotation head up to a maximum pull back being twice the pull back of the lowest maximum pull back provided by the winch pull back system and the ram traverse system when the maximum pull back provided by the winch pull back system and the ram traverse system are different. In this embodiment the method may comprise upon reaching the pull back force of winch pull back system or ram traverse system having the lowest maximum pull back capacity, providing additional hydraulic pressure to the winch pull back system or ram traverse system having the highest maximum pull back capacity wherein the maximum pull back provided is the sum of the maximum pull back of winch pull back system and the ram traverse system.

A third aspect of the invention provides a method of increasing the drill depth capacity of a drill rig having a drill tower, a rotation head traversable along the drill tower and a ram traverse system having at least one ram capable of providing both pull down and pull up force to the rotation head and traversing the rotation head for substantially a full length of the tower, the method comprising: mounting a winch of a winch pullback system on the tower and selectively engaging the winch pull back system with the rotation head to provide additional pull back.

The method may comprise strengthening the drill tower to bear a load up to at least the sum of the load that can be supported by the ram traverse system and the winch pull back system in combination.

A fourth aspect of the invention provides a drill rig comprising:

a drill tower and a rotation head traversable along the drill tower; a ram traverse system having at least one ram capable of providing both pull down and pull back force to the rotation head and arranged to traverse the rotation head along substantially a full length of the tower;

a winch pull back system having a winch mounted on the drill tower, the winch pull back system selectively engagable with the rotation head to provide additional pull back force to the rotation head.

In one embodiment the tower is arranged to be selectively moveable between a substantially horizontal position and a substantially vertical position while the winch pull back system is engaged without traversing the rotation head along the tower.

BRIEF DESCRIPTION OF THE DRAWINGS

An embodiment of the present invention will now be described in detail with reference to the accompanying drawings in which.

DETAILED DESCRIPTION OF PREFERRED EMBODIMENT

Figure 1:
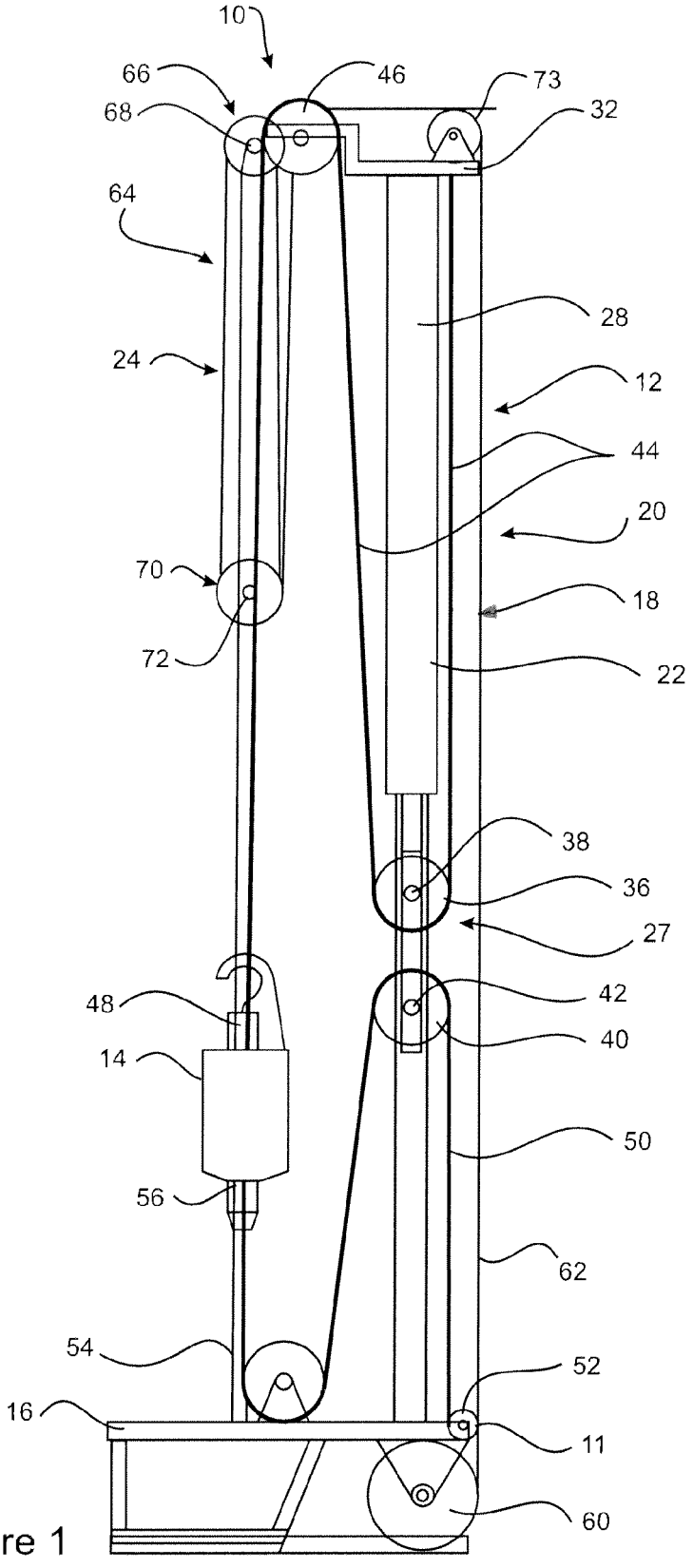
FIG. 1 is a side view of a drill rig incorporating an embodiment of the drill rig traverse system in accordance with the present invention; and, FIG. 2 is a front view of the drill rig shown in FIG. 1.
Figure 2:
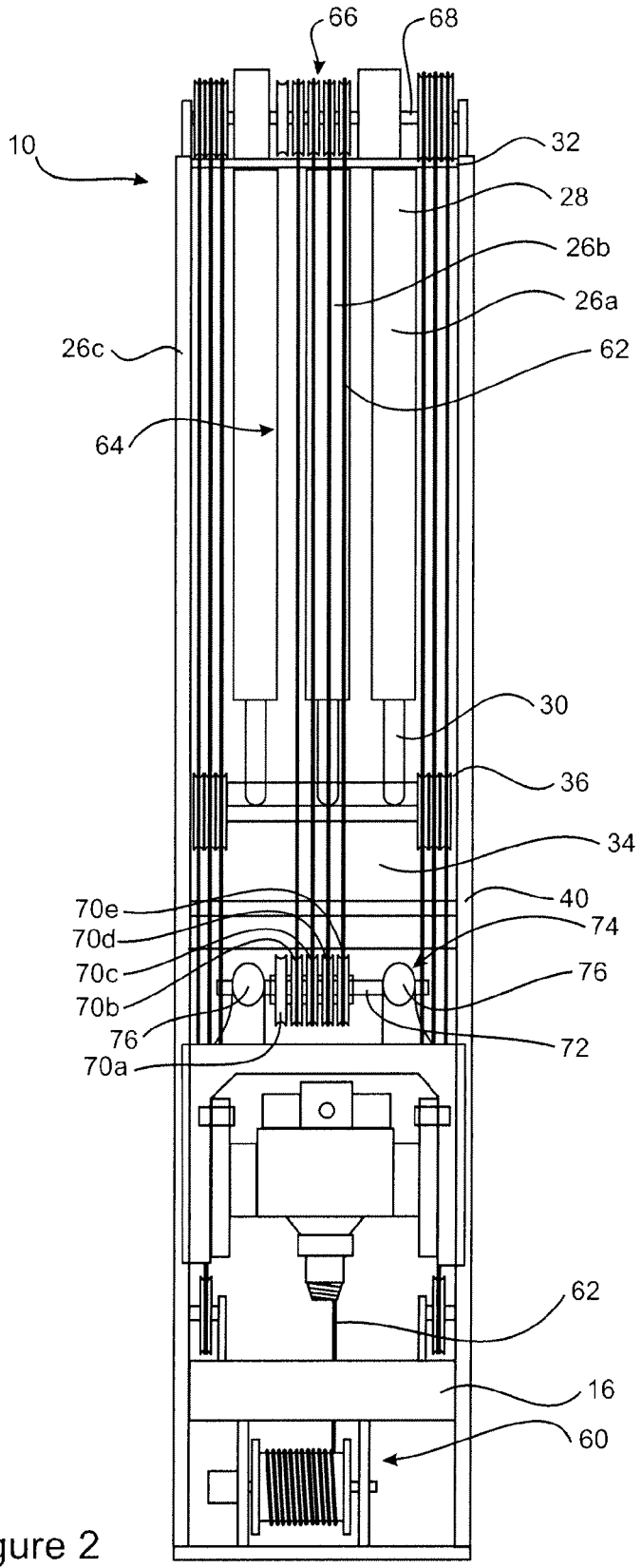

FIGS. 1 and 2 illustrate a drill rig 10 comprising a drill tower 12, rotation head 14 and drill table 16. Drill tower 12 is in the form of a rectangular box frame 18 and is of fixed length. Drill table 16 is provided at a lower end of the frame 18 when the drill rig 10 is in a drilling position. Rotation head 14 provides torque to a drill string (not shown) used for drilling a hole. The drill string passes through a slips (not shown) provided on drill table 16 which is operated in a conventional manner to enable the adding or breaking of a joint. Rotation head 14 is supported on and linearly traversable along drill tower 12.

Drill rig traverse system 20 provides pull back and pull down force to the rotation head 14 enabling the rotation head 14 to traverse along drill tower 12 and controlling contact force between the drill bit and toe of a hole being drilled. Traverse system 20 comprises the combination of a hydraulic ram traverse system 22 which provides both pull back and pull down force; and a winch pull back system 24 which provides pull back only.

In this particular embodiment the hydraulic ram traverse system 22 comprises three hydraulic rams 26*a*, 26*b* and 26*c* (hereinafter referred to in general as "rams 26"); and hydraulic pulley system 27 which comprises: travelling sheave 34; pulleys 46 and 54; and pull back and pull down ropes/chains 44 and 50. Each ram 26 comprises a corresponding cylinder 28 and piston 30. The cylinders 28 are attached or mounted to a top frame portion 32 of tower frame 18. Pistons 30 of the rams 26 are coupled to the travelling sheave 34 which comprises a set of pull back pulleys 36 mounted on a common axle 38; and a set of pull down pulleys 40 mounted on a common axle 42. Pull back ropes or chains 44 (hereinafter "ropes 44") are attached at one end to the top frame portion 32; travel about and seat in respective pull back pulleys 36; travel about and seat in respective pull back top pulleys 46 mounted on the top frame portion 32; and, are subsequently attached at end 48 to an upper portion of rotation head 14.

Pull down ropes or chains 50 (hereinafter "ropes 50") are: attached at one end 52 to a lower end of drill tower 12 near drill table 16; travel about and engage respective pull down pulleys 40; travel about and engage respective bottom pull down pulleys 54; and, finally attach at a distal end 56 to a lower end of rotation head 14.

When hydraulic fluid is provided to the rams 26 to extend their respective pistons 30, the travelling sheave 34 moves linearly in a downward direction providing pull back force to the rotation head 14 extending to traverse rotation head 14 in an upward direction along the drill tower 12. In contrast when hydraulic fluid is provided to rams 26 in a manner to cause retraction of pistons 30, the travelling sheave 34 moves in an upward direction and applies a pull down force to rotation head 14 through the pull down ropes or chains 50. In this way the hydraulic ram traverse system 22 is able to traverse the rotation head 14 linearly up and down the drill tower 12.

The hydraulic ram traverse system 22 is able to cause the rotation head to traverse substantially the full length of tower 12. This arises from a combined effect of the length of the rams 26 and hydraulic pulley system 27. The hydraulic pulley system 27 traverses the rotation head 14 along the tower 12 by twice the extension or retraction displacement of the ram 26. For example a one meter extension of ram 26 provides a two meter displacement of the rotation head along tower 12. This is due to the provision of the travelling sheave 34 and the coupling of the rotation head at opposite ends to the pull back and pull down ropes 44 and 50. Each ram 26 is arranged to have a length of about one half the length of the tower 12, and associated piston 30 to have a maximum extension of about one half of the length of the tower. Thus operating the rams 26 to fully extend the pistons from their full retracted position, enables the rotation head to traverse the full length of tower 12 between pulleys 46 and 54.

The pull back and pull down ropes 44 and 50 are rated to bear the maximum pull down and pull back forces that can be applied by the hydraulic ram traverse system 22. When hydraulic ram traverse system 22 comprises a plurality of rams as in the present embodiment, the rams may be operated to either act together in a conventional manner (i.e. all operated simultaneously under the same hydraulic pressure), or in a progressive manner as described in Applicant's co-pending international application no. PCT/AU2010/000323 the contents of which is incorporated herein by way of reference.

However by way of brief explanation the progressive system described in PCT/AU2010/000323 comprises a plurality of rams which can apply pull back and pull down force to a rotation head via a travelling sheave. The rams are selectively operable to enable the pull back applied to the rotation head to be selectively varied and indeed progressively increased or decreased. In one example the progressive system comprises first, second and third rams. Initially the first ram is selected ("switched in") to operate to drill to a first depth. When the maximum pull back available from the first ram is reached, this ram is decoupled ("switched out"), and the second and third rams are selected to operate to enable drilling to a second greater depth. When it is required to drill to a deeper third depth, all three rams are selected to apply pull back to the rotation head. The rams are arranged to symmetrically apply force to the travelling sheave as they are switched in or out. So if say the first ram is arranged along a line of symmetry of the travelling sheave then the second and third rams are disposed equal distance one to each side of the first ram. To progressively increase the pull back force that can be applied to the rotation head initially only the first ram is switch in; then the first ram is switched out and only the second and third ram are switched in; and finally all three are switched in. In each instance the total force applied by the switched in ram(s) is applied symmetrically to the travelling sheave. The rams 26*a*, 26*b* and 26*c* of the present embodiment may be operated in this manner if desired.

The winch pull back system 24 comprises a winch 60 which in this embodiment is mounted to the drill tower 12 at a location near and below drill table 16. Winch 60 is selectively engagable with the rotation head 14 to provide additional pull back force via rope or chain (hereinafter referred to in general as "rope") 62. In this embodiment to provide mechanical advantage, the winch pull back system 24 incorporates a compound pulley system 64 about which rope 62 travels. Compound pulley 64 comprises in this embodiment a set of five pulleys 66*a*-66*e* (hereinafter referred to in general as "pulleys 66") each of which is rotatably mounted on a fixed axle 68 coupled to the top frame portion 32 of drill tower 12. Compound pulley 64 further comprises a set of pulleys 70*a*-70*e* (hereinafter referred to in general as "pulleys 70") each of which is rotatably mounted to a common movable axle 72. Rope 62 is wound about pulleys 66 and 70 to provide the required mechanical advantage. In the present depicted embodiment rope 62 is wound about four fixed axle pulleys 66*a*-66*d* and four movable axle pulleys 70*a*-70*d* to provide a four times mechanical advantage in pull back force. That is for example, if winch 60 and rope 62 are rated to provide a force of 25 tonne, then by virtue of the compound pulley 64 and the winding of rope 62 about four of the pulleys 66 and 70, the total maximum pull back force that can be provided by winch 60 is 100 tonnes.

Winch rope 62 extends from winch 62 via a first idler pulley 71 near table 16 and a second idler pulley 73 mounted on top frame portion 32 to the compound pulley 64.

A hook assembly 74 is provided at an upper end of rotation head 14 to enable the selective engagement of winch 60 with rotation head 14. Hook assembly 74 comprises two shackle pin hooks 76 which can engage the movable axle 72. A locking mechanism (not shown) may be provided to releasably lock the axle 72 to the hook assembly 74.

The winch pull back system 24 is also able to traverse the rotation head substantially the full length of drill tower 12. Thus both hydraulic ram traverse system 22 and winch pull back system 24 can be simultaneously connected to the rotation head 14 and apply pull back force while traversing the rotation head 14 for substantially the full length of the tower 12.

In one embodiment, both the ram traverse system 22 and the winch pull back system 24 are operated by a common hydraulic fluid supply or motor. Further, the systems are arranged so that each is provided with the same fluid pressure. For example respective hydraulic lines (i.e. hose) couple the common hydraulic supply to the systems 22 and 24. However, if systems 22 and 24 have a different maximum force/load rating or capacity, then fluid pressure is limited or diverted from the system having the lowest maximum force rating once the pressure commensurate with that force rating is reached. This can be achieved by use of a pressure relief or limiting valve in the hydraulic line between the common hydraulic supply and the system 22, 24 having the lowest maximum force rating. Say for example that the ram traverse system 22 has a maximum force rating or pull back of 150 tonne and the winch pull back system 24 has a maximum rating of 100 tonne (being 25 tonne times the 4 times mechanical advantage provided by compound pulley 64). Initially drilling is conducted using the ram traverse system 22 only to provide pull down and pull back force. When the depth of the hole (i.e. length of the drill string) reaches a stage where the maximum pull back of 150 tonne provided by the ram traverse system 22 is reached then the winch pull back system 22 is coupled to the drill head 14 to provide additional pull back thus allowing a deeper hole to be drilled.

Upon engagement of the winch pull back system 24 both winch pull back system 24 and ram traverse system 22 are supplied with the same hydraulic fluid pressure from a common hydraulic fluid supply or motor. Accordingly each system will apply the same pull back force, or stated another way; the pull back force required for any particular application is shared equally so that the winch traverse system 24 and ram traverse system 22 apply an equal pull back force to rotation head 14. So if ram traverse system 22 was applying 150 tonne immediately prior to the engagement of winch 60 with rotation head 14, then after that engagement, both the ram traverse system 22 and winch traverse system 24 will apply 75 tonnes. Both systems continue to provide equal pull back force as they are provided with the same fluid pressure until the lowest of the maximum pull back ratings of each system is reached. In this instance winch pull back system 24 has the lowest maximum pull back rating of 100 tonne (compared to 150 tonne of the ram traverse system). Fluid pressure is provided evenly to both systems until the pressure which enables winch traverse system 24 to apply a pull back of 100 tonne is reached. At this time, the total pull back provided on rotation head 14 is 200 tonne.

However the maximum total pull back that can be provided by the system 20 is 250 tonne. The additional 50 tonne of pull back is now provided via the ram traverse system 22 only with a pressure relief or limiting valve operating in a line to the winch pull back system 24. Thus although the same fluid pressure is being provided from a common source to both systems 22 and 24, due to the pressure relief valve there is a difference in pressure that reaches the systems 22 and 24. Of course, if both systems 22 and 24 have the same rating then fluid pressure is provided evenly to both systems until the common maximum pressure is reached. In alternate embodiments, it may be that the winch pull back system 24 provides a greater maximum pull back than the ram system 22. In that instance, the operation is identical to described above except that the pressure relief or limiting valve is in the line to the ram traverse system 22.

Thus the same fluid pressure is provided to respective hydraulic lines for powering both the ram system 22 and winch system 24. But if the systems have different maximum capacity a pressure relief or pressure limiting valve may be placed in the line of the system having the lower maximum capacity.

The addition of the winch pull back system enables a substantial increase in the maximum drill depth of a drill rig without a need to increase the capacity of the hydraulic supply and indeed the fuel burn required to drive the motors which in turn drive hydraulic motors for the fluid supply. It will be understood that while the rig is able to provide increased pull back, there is no increase in the pull back provided by the ram traverse system. Once the maximum load of the ram traverse system has been reached, the additional load from every further joint or rod added to the drill string to enable increased drilling depth is shared evenly by the winch traverse system 24 and ram traverse system 22 (with, as described above, the load on the ram traverse system 22 decreasing by one half immediately upon engagement of the winch traverse system).

By coupling both systems 22 and 24 to a common hydraulic fluid supply or motor each is able to apply equal pull back force to the rotation head a least until the lowest maximum force rating (in the event the maximum force rating for each is not the same) is reached. The ram and winch systems are arranged to provide their pull back force at substantially the same rate to the rotation head 14. That is each system is arranged to have the same nominal effective speed. For example if a nominal rate of travel of the rotation head 14 along tower 12 is 1 m/s then (a) the rams are arranged to extend or retract at about 0.5 m/s due to the speed/displacement doubling effect of the pulley system 27 described above; and (b) the winch is rotated to payout or reel in the winch rope at 4 m/s due to the effect of the compound pulley 64. The compound pulley reduces speed of travel by a factor equal to the number of loops of the rope about the compound pulley (which in this instance is four). Nevertheless even if the effective speed of the ram system and winch system were different, by coupling both to the common hydraulic supply, each would still apply the same force to the rotation head and the speed of the rotation head will be slowed to the slower of the ram system and winch system.

In one embodiment, the rams may be disengaged form from the drill head 14 and the winch pull back system 24 alone can be used to provide pull back provided the weight (i.e. length) of the drill string is not such to exceed the maximum pull back rating of the winch system 24. This enables the drill string to be pulled from the hole to change a bit more quickly because the winch pull back system is able to lift the drill string by the length of the rod at a greater speed than the ram system.

Embodiments of the present invention enable the drilling depth of a standard drill rig to be substantially increased by the retrofitting of a winch traverse system and, where necessary, providing further strengthened support to the tower 12 to carry the additional load provided by an increased length drill string.

Drill rig 10 may be arranged so the tower 12 can be moved between a transport or stowed position where the tower lies horizontally and a drilling position where the tower is substantially vertical. This feature is particularly useful when the rig 10 is mounted on a vehicle, although it is also useful when the tower is mounted to a fixed base. The motion of the tower between these positions is controlled by a separate device such a ram (not shown). By wholly mounting the winch system 24 and in particular winch 60 on the drill tower 12 it is possible to move the tower 12 from the vertical position to the horizontal position (sometimes known as "dumping the tower") without the need to disengage the winch system 24 (or indeed the hydraulic system 22) from the rotation head 14. In contrast in systems where a winch that can be coupled to a rotation head but is mounted separately from the tower itself, dumping of the tower without decoupling the winch will cause the rotation head to traverse along the tower which presents a substantial safety hazard as well running the risk of damaging the rig. An additional benefit of mounting the winch system in this manner is that it allows the drill tower to be operated, and thus a hole to be drilled, at any angle for horizontal to vertical while again maintaining the ability for both the ram and winch traverse systems to simultaneously apply pull back force and traverse the rotation head the full length of the tower.

Now that embodiments of the invention have been described in detail it will be apparent to those skilled in the relevant arts that numerous modifications and variations may be made without departing from the basic inventive concepts. For example, winch 60 is described as being a hydraulic winch. However winch 60 may alternately be an electric winch. Further, the number of rams utilised in the ram traverse system is immaterial to the substance of the invention. As previously described a standard system may be used or alternately a multi ram system as described in International application no. PCT/AU2010/000323 may be used where the rams are sequentially enabled to provide increased pull back as drilling depth increases. When the sequential ram system of PCT/AU2010/000323 is incorporated the winch pull back system will be engaged after all ram are operational and applying pull back. Embodiments of the invention may be incorporated in land based fixed or mobile drill rigs, and on offshore drill rigs.

All such modifications and variations together with others that would be obvious to persons of ordinary skill in the art are deemed to be within the scope of the present invention the nature of which is to be determined from the above description and the appended claims.

The invention claimed is:

1. A drill rig traverse system for a drill rig having a drill tower, a rotation head linearly traversable on the drill tower, and a travelling sheave trolley supported on the drill tower for linear motion along the drill tower and coupled to the rotation head wherein a force applied in one direction to the travelling sheave trolley is transferred as a force action in an opposite direction to the rotation head, the drill rig traverse system comprising:

ram traverse system having a plurality of rams capable of applying selectively variable force symmetrically to the travelling sheave trolley in either direction along the drill tower, wherein the selectively variable force is transferred by the travelling sheave trolley to the rotation head to apply both pull down and pull back force to the rotation head, the ram traverse system being arranged to traverse the rotation head for substantially a full length of an associated tower; and, a winch pull back system selectively engagable with the rotation head to provide additional pull back force to the rotation head, the winch pull back system having a winch that in use is mounted on the tower.

2. The drill rig traverse system according to claim 1 wherein the plurality of rams is capable of being actuated and coupled to the travelling sheave trolley to progressively increase by one the number of rams applying force to the travelling sheave trolley.

3. The drill rig traverse system according to claim 1 wherein the plurality of rams comprises at least one primary ram operable to apply force to the travelling sheave trolley at a location along a line of symmetry of the travelling sheave trolley.

4. The drill rig traverse system according to claim 3 wherein the plurality of rams comprises a single primary ram, and an even number of secondary rams, wherein the secondary rams are arranged in pairs, the rams in each pair symmetrically disposed about the primary ram.

5. The drill rig traverse system according to claim 1 wherein the winch pull back system applies pull back force to the rotation head through a pulley arrangement which is arranged to provide a mechanical advantage of two or more.

6. The drill rig traverse system according to claim 5 wherein the pulley arrangement is a compound pulley having a moveable axle on which a plurality of pulley wheels is rotatably supported.

7. The drill rig traverse system according to claim 6 wherein the movable axle is selectively engagable with the rotation head.

8. The drill rig traverse system according to claim 1 comprising a hydraulic fluid supply system and wherein the winch pull back system is hydraulically operated, the hydraulic fluid supply system being arranged to provide hydraulic fluid to both the winch pull back system and the ram traverse system.

9. The drill rig traverse system according to claim 1 wherein the ram traverse system comprises one or more rams and a ram pulley system arranged to cause the rotation head to traverse along the tower by a distance twice an extension or retraction displacement of the one or more rams.

10. The drill rig traverse system according to claim 1 wherein the pulley arrangement comprises a fixed axle which is fixed to the drill tower and wherein a plurality of pulley wheels is rotatably supported on the fixed axle.

11. The drill rig traverse system according to claim 1 wherein the winch is mounted on the drill tower below a drill table of the drill rig.

12. A method of drilling a hole comprising:

providing a drill rig having a drill tower, a rotation head arranged to traverse substantially a full length of the tower, a travelling sheave trolley supported on the drill tower for linear motion along the drill tower and coupled to the rotation head wherein a force applied in one direction to the travelling sheave trolley is transferred as a force acting in an opposite direction to the rotation head, and a ram traverse system having a plurality of rams coupled to the rotation head and drill tower to provide pull back and pull down force the ram traverse system arranged to traverse the rotation head substantially a full length of the tower, the plurality of rams further capable of applying selectively variable force symmetrically to the travelling sheave trolley in either direction along the drill tower, wherein the selectively variable force is transferred by the travelling sheave trolley to the rotation head to apply both pull down and pull back force to the rotation head;

mounting a winch of a winch pull back system on the drill tower;

operating the drill rig to drill a hole to a depth where pull back force is required to be provided by the ram traverse system during drilling of the hole in a manner which includes selectively actuating one or more of the plurality of rams to apply progressively increasing force symmetrically to the travelling sheave trolley; and, selectively engaging the winch pull back system with the rotation head to provide additional pull up force while simultaneously operating the ram traverse system to provide pull back force to the rotation head.

13. The method according to claim 12 wherein operating the drill rig to drill a hole comprises operating the drill rig to drill the hole to a first depth limited by a maximum pull back force provided by the ram traverse system, and engaging the winch pull back system with the rotation head and operating the drill rig to continue drilling the hole to a second deeper depth limited by a combined pull back force of the ram traverse system and the winch pull back system.

14. The method according to claim 12 comprising operating the winch pull back system and the ram traverse system from a common hydraulic fluid supply.

15. A drill rig comprising:

a drill tower, a rotation head traversable along the drill tower, and a travelling sheave trolley supported on the drill tower for linear motion along the drill tower and coupled to the rotation head wherein a force applied in one direction to the travelling sheave trolley is transferred as a force acting in an opposite direction to the rotation head;

a ram traverse system having a plurality of rams capable of providing both pull down and pull back force to the rotation head and arranged to traverse the rotation head along substantially a full length of the tower, the plurality of rams further capable of applying selectively variable force symmetrically to the travelling sheave trolley in either direction along the drill tower, wherein the selectively variable force is transferred by the travelling sheave trolley to the rotation head to apply both pull down and pull back force to the rotation head;

a winch pull back system having a winch mounted on the drill tower, the winch pull back system selectively engagable with the rotation head to provide additional pull back force to the rotation head and arranged to traverse the rotation head along substantially a full length of the tower.

16. The drill rig according to claim 15 wherein the tower is arranged to be selectively moveable between a substantially horizontal position and a substantially vertical position while the winch pull back system is engaged without traversing the rotation head along the tower.

17. The drill rig according to claim 15 wherein the winch pull back system applies pull back force to the rotation head through a pulley arrangement which is arranged to provide a mechanical advantage of two or more.

18. The drill rig according to claim 15 wherein the winch pull back system and the ram traverse system are arranged to apply equal pull back force when the winch is engaged with the rotation head.

19. The drill rig according to claim 18 comprising a hydraulic fluid supply system and wherein the winch pull back system is hydraulically operated, the hydraulic fluid supply system being arranged to provide hydraulic fluid to both the winch pull back system and the ram traverse system.

20. The drill rig traverse system according to claim 15 wherein the ram traverse system comprises one or more rams and a ram pulley system arranged to cause the rotation head to traverse along the tower by a distance twice an extension or retraction displacement of the one or more rams.

* * * * *